United States Patent [19]

Troncoso

[11] Patent Number: 4,911,137

[45] Date of Patent: Mar. 27, 1990

[54] ARCHERY ARROW-CENTERING DEVICE

[75] Inventor: Vincent F. Troncoso, Montrose, Colo.

[73] Assignee: Golden Key-Futura, Inc., Montrose, Colo.

[21] Appl. No.: 375,285

[22] Filed: Jul. 3, 1989

[51] Int. Cl.[4] ..... F41B 5/00

[52] U.S. Cl. ..... 33/506; 124/86; 124/88

[58] Field of Search ..... 124/23 R, 24 R, 41 A, 124/86, 88, DIG. 1, 1; 33/265, 506, 645

[56] References Cited

U.S. PATENT DOCUMENTS

| | | | |
|---|---|---|---|
| 3,088,212 | 5/1963 | Smith | 33/506 |
| 3,651,578 | 3/1972 | Saunders et al. | 33/506 |
| 4,382,339 | 5/1983 | Saunders | 33/265 |
| 4,594,786 | 6/1986 | Rezmer | 33/265 X |

*Primary Examiner*—Randolph A. Reese
*Assistant Examiner*—John Ricci
*Attorney, Agent, or Firm*—Donald E. Nist

[57] ABSTRACT

The archery device permits an archery arrow to be correctly centered along is length with respect to the bowstring so that upon release of the bowstring the arrow will fire straight ahead with improved accuracy. The device includes an elongated arm which is either L-shaped or U-shaped, a connector for releasably securing the arm to the sidewall of an archery bow and an aligning component. The aligning component enables one to mark the transverse position of the bowstring and then position the front of an arrow, when the rear of the arrow is attached to the bowstring, at the same transverse position as the bowstring so that the arrow is aligned with the bowstring and parallel to the sidewall of the archery bow. The connector allows the arm to be rotated therearound in a plane parallel to the sidewall of the bow and can include a threaded post. The first portion of the arm extends parallel to the sidewall and the second portion or portions of the arm, which are integrally secured to one or both opposite ends of the first portion, extend transversely of the bow toward the bowstring and are perpendicular to the first portion. The aligning component is either a slide on the second portion or portions or a scale on those portions. The device is simple, lightweight and accurate.

8 Claims, 2 Drawing Sheets

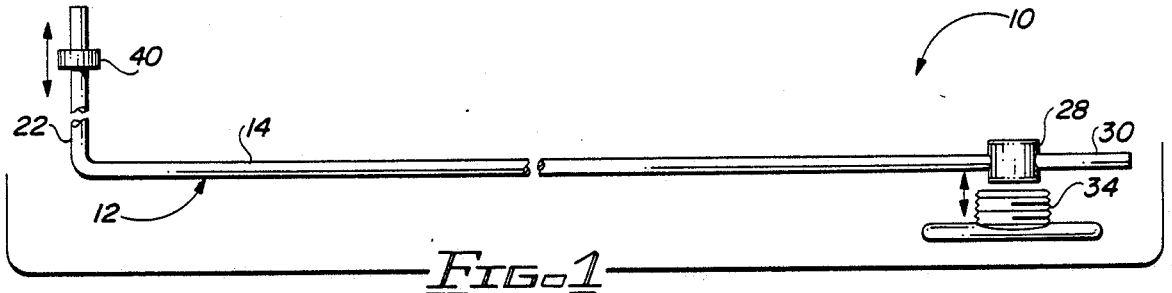
FIG. 1
FIG. 2
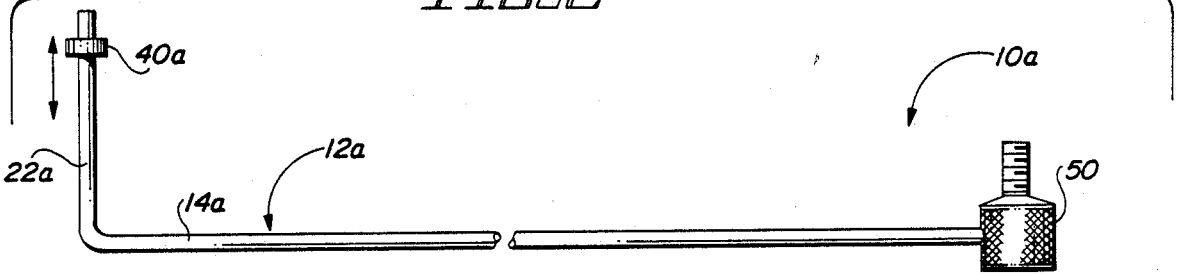
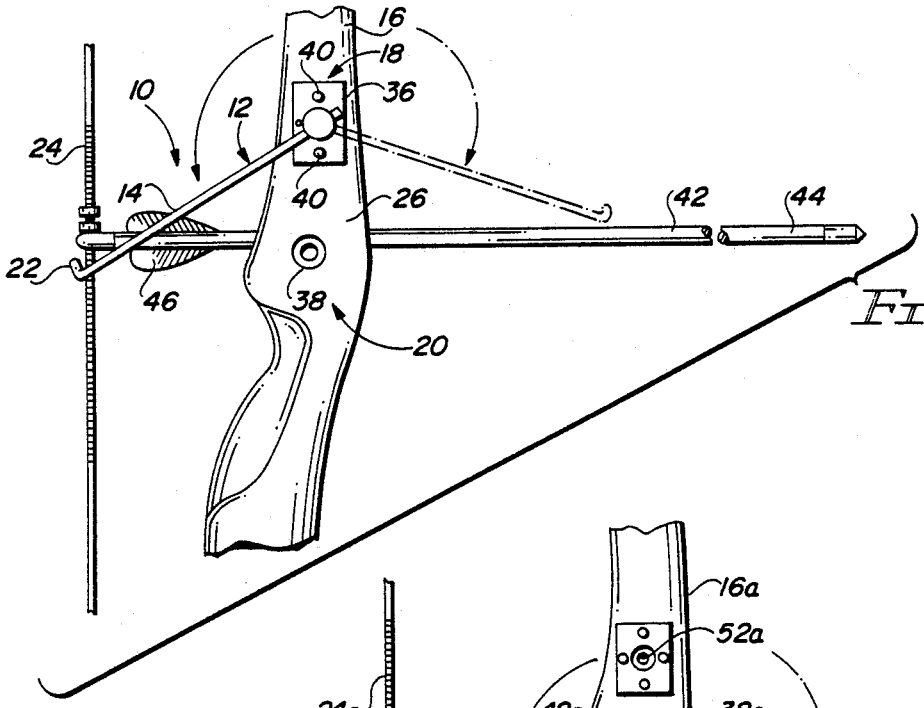
FIG. 3
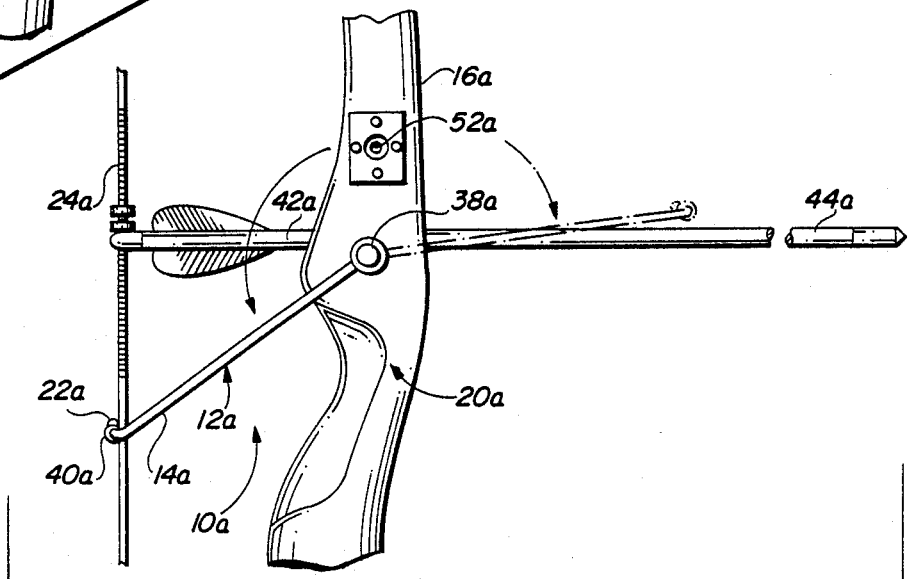
FIG. 4

ARCHERY ARROW-CENTERING DEVICE

BACKGROUND OF THE INVENTION

1. Field of the Invention

The present invention generally relates to sports devices and more particularly to a device for accurately centering an arrow in an archery bow.

2. Prior Art

There is a need for properly centering an arrow in an archery bow so that the arrow will shoot correctly, accurately and without diverging from the original sighting line from which it was aimed and shot. This is particularly critical with respect to compound archery bows which were introduced in the late 1960's and which have become very popular with archers. One common method employed by archers to try and determine the true centershot position of a bow is to shoot one unfletched arrow and two or more fletched arrows from the bow and observe the orientation of the shot arrows in the archery target before adjusting the in/out placement of the arrow rest and cushion plunger. Much shooting and adjusting must be made before the arrows group in the target bale with about the same vertical orientation, indicating a center-shot position.

Another method of determining the center-shot position is to dangle an arrow from the bowstring while the bow is suspended face down between two supports. The proper position of the rest and/or plunger is then guessed at, the plunger and/or rest are adjusted and the bow is retested until it is correct as to the center-shot position.

No simple device has yet been devised for accurately and precisely determining the center-shot position in an archery bow. Such device is needed in view of the inaccuracies and laborious nature of the above-described hand methods. Such device should enable the center-shot determination to be made rapidly and without having to dismantle the archery bow. Preferably, the device should be light in weight, inexpensive, durable and compact.

SUMMARY OF THE INVENTION

The improved archery arrow centering device of the present invention satisfies all the foregoing needs. The device is substantially as set forth in the Abstract of the Disclosure.

Thus, the device comprises an L-shaped or U-shaped arm having a first long portion adapted to be held parallel to the front-rear axis of the archery bow against the bow sidewall in the riser section of the bow by a transverse threaded post or the like releasably retained in the plunger hole or in the bow sight block hole, both of which holes extend transversely through the sidewall of the bow. The first portion of the arm can be rotated in a plane parallel to the sidewall by the threaded post and bears a single transverse second portion in the case of the L-shaped arm and two such second portions at opposite ends of the first portion in the case of the U-shaped arm. The second portion or portions are about perpendicular to the first portion and extend towards the bow window and bowstring when the arm is mounted on the archery bow.

The second portion or portions bear aligning means in the form of one or more slide members for marking the transverse position of the bowstring relative to the bow sidewall and for aligning the front of an archery arrow when on the bowstring with that same relative position so that the arrow is parallel with the sidewall and in line with the bowstring. The arrow is then held in that desired center-shot position by repositioning the sidewall of the arrow rest and/or the cushion plunger to bear against the side of the arrow shaft.

The aligning means can, if desired, be a scale fixed to and extending along the second portion or portions with which to mark the position of the bowstring. In the case of the L-shaped arm, the arm is first placed in the rear position near the bowstring and the position of the bowstring is noted thereon, after which the arm is removed reconnected so that it extends forward of the bow riser and is then brought against the arrow front so that the latter can be accurately positioned while the arrow rest and/or plunger are adjusted. In the case of the U-shaped arm, a scale may be attached to the outside rear of the device and the inside front of the device. The rear scale is then read to determine the transverse position of the bowstring and the front of the arrow is moved to coincide with the same reading on the front scale, after which the arrow rest and/or plunger are adjusted accordingly.

The arm can be of metal, plastic, wood, ceramic or the like. The post can be of similar material, as can the slide member. The scale can be of tape or engraved in the second portion(s) of the arm. The device is light in weight, compact, inexpensive, durable and efficient. Further features of the present invention are set forth in the following detailed description and accompanying drawings.

DRAWINGS

FIG. 1 is a schematic, fragmentary top plan view of a first preferred embodiment of the improved arrow-centering device of the present invention;

FIG. 2 is a schematic top plan view of a second preferred embodiment of the improved arrow-centering device of the present invention;

FIG. 3 is a schematic side elevation of the device of FIG. 1 shown positioned against a bowstring on an archery bow;

FIG. 4 is a schematic side elevation of the device of FIG. 2 shown positioned against a bowstring on an archery bow;

DETAILED DESCRIPTION

Figure 5:
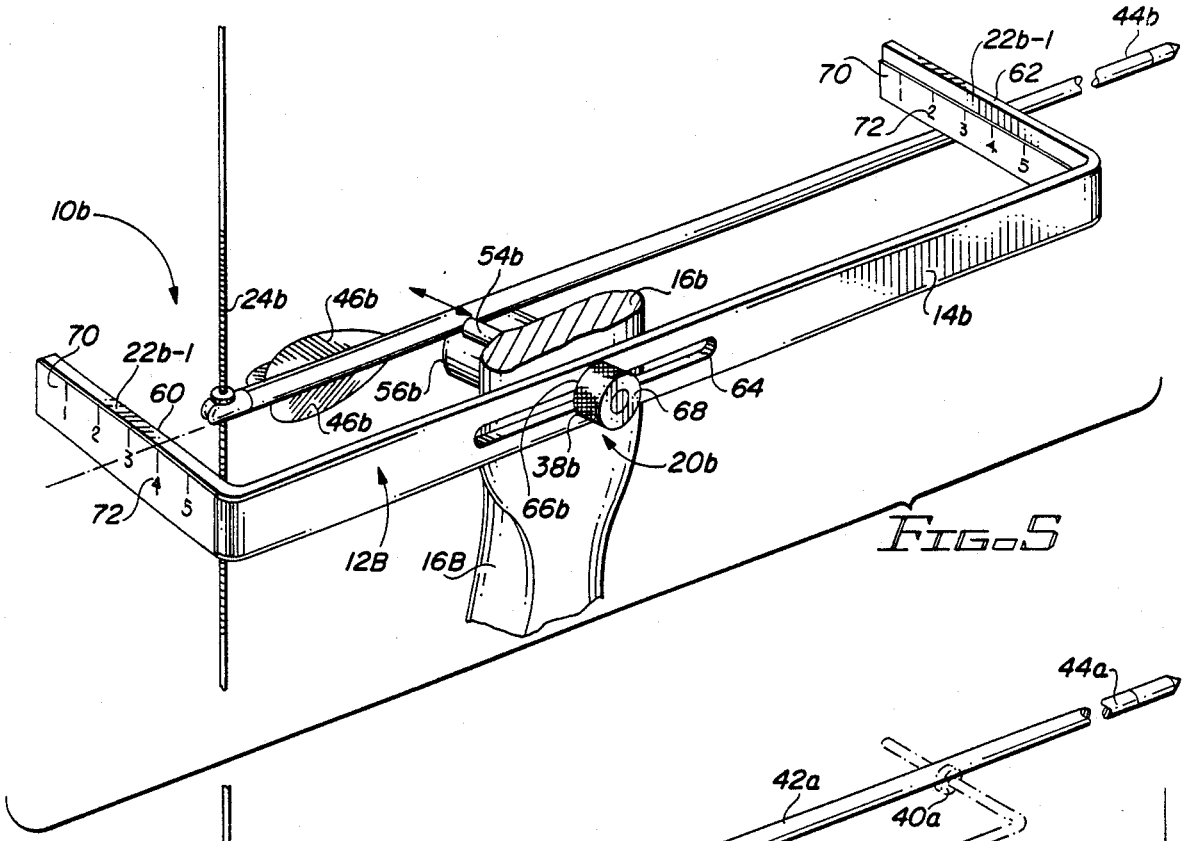
FIGS. 5 and 7 are schematic perspective views, partly broken away, of third and fourth preferred embodiments of the improved arrow-centering device of the present invention; and, FIG. 6 is a schematic perspective view, partly broken away, of the device of FIGS. 2 and 4, shown connected to the sidewall of an archery bow.

1. FIGS. 1 and 3.

Now referring more particularly to FIGS. 1 and 3 of the accompanying drawings, one preferred embodiment of the improved arrow-centering device of the present invention is schematically depicted therein. Thus, device 10 is shown which comprises an L-shaped arm 12 having an elongated first portion 14 adapted to be held parallel to the sidewall 16 in the riser section 18 of an archery bow 20 and a second shorter portion 22 integral with first portion 14 and extending at a right angle thereto toward the bowstring 24 of bow 20 on the side of sidewall 16 opposite to that to which portion 14 is shown attached in FIG. 3.

Thus, portion 14 is shown releasably connected to the outside 26 of sidewall 16 by a connector comprising a cylinder 28 secured to the free front end 30 of portion 14 and fitting into an opening (not shown) in an externally threaded knob 32. The threaded shank portion 34 of knob 32 screws into the usual sight block hole (not shown) in the center of a sight block mounting plate 36 above the plunger hole 38. Both such holes extend transversely through sidewall 16 from outside 26 to the arrow window (not shown) on the opposite side of sidewall 16. Mounting 36 may include leveling screws 40 for placing mounting 36 in a true vertical orientation on bow 20. Cylinder 28 is placed in the sight block hole and rotated to bring portion 22 adjacent to bowstring 24. Arm 12 can be locked into such position by knob 32 which fits over cylinder 28 in the sight block hole.

Device 10 includes aligning means in the form of a sliding ring or tube 40 slideably disposed on portion 22. Tube 40 is slid on portion 22 until it is directly behind, in front of or next to bowstring 24. Knob 34 is then loosened, and arm 12 is removed from bow 20, rotated forward to the position shown in dotted outline in FIG. 3 and cylinder 28 is reinserted into the sight block hole and held in place by knob 32. An arrow 42 is clipped to bowstring 24 and the front end 44 of arrow 42 is held directly in line with tube 40 so that arrow 42 projects directly forward of bowstring 24 and parallel to sidewall 16, and also parallel to the front-rear axis of bow 20. Plunger 38 is then screwed in or out to abut the side of arrow 42 and hold it in the true center-shot position necessary for optimal shooting without interference with the vanes 46 of arrow 42. Thus, the position of the rear of arrow 42 and bowstring 24 is duplicated at the front 44 of arrow 42 so that arrow 42 is perfectly aligned in bow 20.

Arm 12, tube 40, cylinder 28 and knob 32 can be made of any suitable materials such as aluminum, brass, copper, steel, plastic, wood, ceramic or any suitable combination or mixture thereof and in any suitable size. Device 10 is light in weight, simple, inexpensive, durable and efficient.

Figure 6:
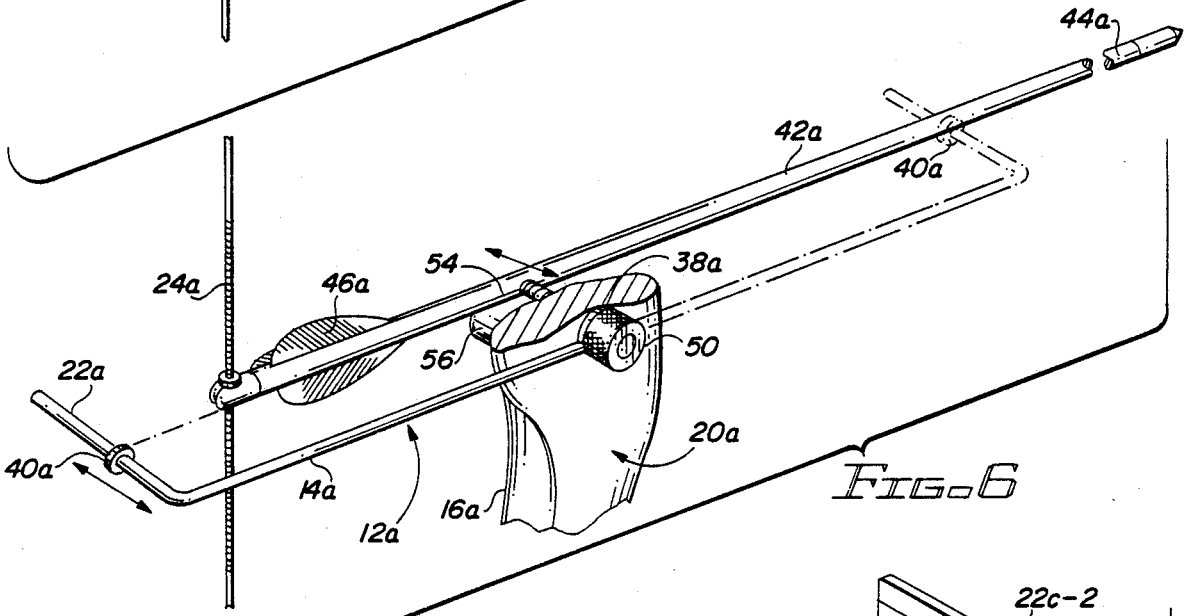

2. FIGS. 2, 4 and 6.

A second preferred embodiment of the improved arrow-centering device of the present invention is schematically depicted in FIGS. 2, 4 and 6. Thus, device **10*a* is shown. Components thereof similar to those of device 10** bear the same numerals but are succeeded by the letter "a".

Device **10*a* is substantially identical to device 10**, except as follows:

(a) the connector of device **10*a* comprises a threaded screw 50 designed to be threaded into the rear end of a conventional Burger-type button or plunger 38*a* (or into the threaded opening left by the plunger when it is removed from bow 20*a*) as shown in FIG. 4; and, (b) cylinder 28 and knob 34 are absent, since the sight block hole 52 of bow 20*a* is not used as a mounting means for device 10*a***.

Device **10*a* is used in a manner substantially identical to that of device 10 and has substantially the same advantages. Plunger button 54 is used to correctly space arrow 42*a* from sidewall 16 on arrow rest 56 after the proper true center-shot position for arrow 42*a* has been determined by device 10*a***.

3. FIG. 5

A third preferred embodiment of the improvement arrow centering device of the present invention is schematically depicted in FIG. 5. Thus, device **10*b* is shown. Components thereof similar to those of device 10 or 10*a*** bear the same numerals but are succeeded by the letter "b".

Device **10*b* is substantially identical to device 10*d*** except as follows:

(a) arm **12*b* is U-shaped instead of being L-shaped. It comprises a pair of L-shaped elements joined end-to-end. Thus, arm 12*b* comprises an elongated first portion 14*b* and two second portions 22*b*-1 and 22*b*-2 at the opposite free ends of portion 14*b*, that is, at the rear and front ends 60 and 62**, respectively, thereof.

(b) portion **14*b* bears an elongated central slot 64 through which the shank 66 of the rear head portion 68 of plunger 38*b* extends transversly to releasably hold portion 14*b* parallel to and against the outside of sidewall 16*b* of bow 20*b***.

(c) the aligning means for device **10*b* comprises paper or plastic tape 70 bearing scale indicia 72, affixed to the outer rear of portion 22*b*-1 and to the inner front of portion 22*b*-2. The relative transverse spacing of bowstring 24*b* from sidewall 16*b* is determined by reference to rear scale 72. The front 44*b* of arrow 42*b* is then aligned with the same marking on front scale 72, after which plunger button 54*b* is screwed in or out to abut the side of arrow 42*b* on rest 56*b*, for true center-shot positioning of arrow 42*b* in bow 20*b***.

If desired, scale 72 could be embossed or engraved in portions **22*b*-1 and 22*b*-2 instead of using tape 70. Device 10*b* has the other advantages of devices 10 and 10*a***.

4. FIG. 7

Figure 7:
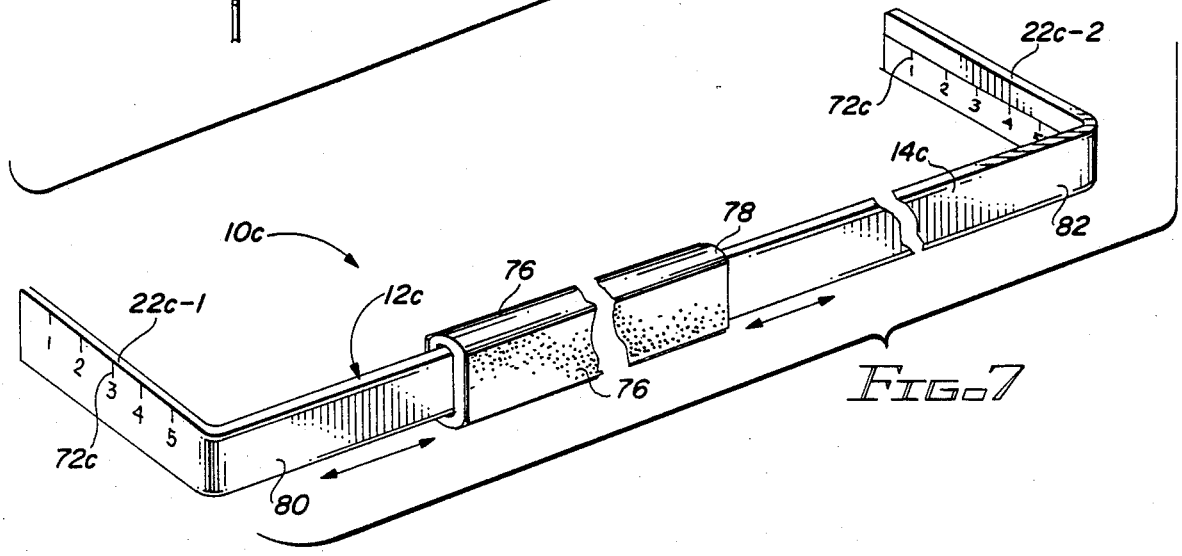

A fourth preferred embodiment of the device of the present invention is schematically depicted in FIG. 7. Thus, device **10*c* is shown. Components thereof similar to those of device 10*b* bear the same numerals but are succeeded by the letter "c". Device 10*c* differs from device 10*b*** only as follows:

(a) slot 64 is absent. Instead, adhesive strips 74 and 76 are disposed on opposite sides of the central part 78 of portion **14*c*, which part 78** is hollow and tubular;

(b) scale **72*c* is engraved into portions 22*c*-1 and 22*c*-2; and, (c) portion 14*c* includes two separate sections 80 and 82 which telescope into part 78**.

Device **10*c* has substantially the advantages of device 10*b***.

Various modifications, changes, alterations and additions can be made in the improved arrow-centering device of the present invention and in its components and parameters. All such modifications, changes, alterations and additions as are within the scope of the appended claims form part of the present invention.

What is claimed is:

1. An improved archery arrow-centering device, said device comprising, in combination:

(a) an elongated L-shaped arm having a first portion adapted for alignment parallel to the sidewall in the riser section of an archery bow, and a second integral portion adapted to extend transversely of an archery bow towards the bowstring of said bow;

(b) means secured to said first portion of said arm for releasably securing said arm to said sidewall of said riser section of said archery bow; and, (c) means connected to said second portion of said arm for aligning the front end of an archery arrow when the rear end of said arrow is connected to said bowstring of said archery bow, so that said front end and rear end of said arrow are spaced laterally the same distance from and parallel to said sidewall, for true center-shot shooting and improved accuracy and arrow flight.

2. The improved arrow-centering device of claim 1 wherein said aligning means comprises a member which slides along said second portion so that the transverse position of said bowstring can be marked, and wherein said securing means comprises a post parallel to said second portion and around which said arm is rotatable to releasably position said slide member against said arrow front.

3. The improved arrow-centering device of claim 2 wherein said post is threaded so as to be engageable with at least one of the plunger hole and the sight block hole extending transversely through said sidewall.

4. The improved arrow-centering device of claim 1 wherein said arm comprises two L-shaped units joined integrally to form a unitary elongated U-shaped component having said first portion and a pair of said second portions, one at each of the two opposite ends of said arm, and wherein said first portion bears an elongated slot extending transversely through the middle thereof comprising said securing means.

5. The improved arrow-centering device of claim 4 wherein said aligning means comprises a first strip bearing marking indicia disposed on the rear outer surface of on of said second portions and a second substantially identical strip disposed on the front outer surface of the other of said second portions.

6. The improved arrow-centering device of claim 5 wherein said securing means includes a threaded post releasably securable to at least one of the plunger hole and the sight block hole extending transversely through said sidewall.

7. The improved arrow-centering device of claim 1 wherein said arm comprises two L-shaped units slideably received in opposite ends of an elongated hollow tube to form a telescoping U-shaped component.

8. The improved arrow-centering device of claim 7 wherein said elongated hollow tube bears adhesive on at least one of two opposite sides thereof for releasably adhering said device to said sidewall of said riser section of said archery bow.

* * * * *